US009592519B2

(12) United States Patent
Mazzola et al.

(10) Patent No.: US 9,592,519 B2
(45) Date of Patent: Mar. 14, 2017

(54) DUAL POSITION EXTERNAL CHARGE RING AND DUAL PRE-ORIFICE RESTRICTION ON A DUAL PURGE SYSTEM

(71) Applicants: Gerry Mazzola, Ottawa Hills, OH (US); Brad Friemoth, Perrysburg, OH (US); John P. Owed, Sylvania, OH (US); David M. Seitz, Riga, MI (US)

(72) Inventors: Gerry Mazzola, Ottawa Hills, OH (US); Brad Friemoth, Perrysburg, OH (US); John P. Owed, Sylvania, OH (US); David M. Seitz, Riga, MI (US)

(73) Assignee: MAGNA EXTERIORS INC., Concord (CA)

( * ) Notice: Subject to any disclaimer, the term of this patent is extended or adjusted under 35 U.S.C. 154(b) by 823 days.

(21) Appl. No.: 13/927,214

(22) Filed: Jun. 26, 2013

(65) Prior Publication Data

US 2014/0001292 A1 Jan. 2, 2014

Related U.S. Application Data

(60) Provisional application No. 61/666,241, filed on Jun. 29, 2012.

(51) Int. Cl.

| | |
|---|---|
| ***B05B 5/00*** | (2006.01) |
| ***B05B 5/03*** | (2006.01) |
| ***B05B 5/04*** | (2006.01) |
| ***B05B 5/053*** | (2006.01) |

(52) U.S. Cl.
CPC ..... *B05B 5/03* (2013.01); *B05B 5/0407* (2013.01); *B05B 5/0533* (2013.01)

(58) Field of Classification Search
CPC ..... B05B 5/03; B05B 5/0407; B05B 5/0533
USPC ..... 239/690
See application file for complete search history.

(56) References Cited

U.S. PATENT DOCUMENTS

| | | | | |
|---|---|---|---|---|
| 5,039,019 | A * | 8/1991 | Weinstein | B05B 5/0533 239/691 |
| 6,006,999 | A * | 12/1999 | Tiessen | B05B 5/0407 239/112 |
| 2008/0011333 | A1* | 1/2008 | Rodgers | B05B 15/0258 134/94.1 |
| 2008/0149026 | A1* | 6/2008 | Cedoz | B05B 5/04 118/308 |
| 2009/0008469 | A1* | 1/2009 | Seitz | B05B 5/0407 239/3 |
| 2009/0140083 | A1* | 6/2009 | Seitz | B05B 5/0533 239/690.1 |
| 2011/0271906 | A1* | 11/2011 | Yamada | B05B 5/0426 118/621 |

* cited by examiner

*Primary Examiner* — Arthur O Hall
*Assistant Examiner* — Joel Zhou
(74) *Attorney, Agent, or Firm* — Warn Partners, P.C.

(57) ABSTRACT

A charge ring and fluid restriction arrangement for a paint spray tool. The paint spray tool has a charge ring that is moveable along the axis of the tool body. The paint spray tool also has interchangeable pre-orifices within the tool body.

12 Claims, 5 Drawing Sheets

DUAL POSITION EXTERNAL CHARGE RING AND DUAL PRE-ORIFICE RESTRICTION ON A DUAL PURGE SYSTEM

CROSS-REFERENCE TO RELATED APPLICATIONS

This application claims the benefit of U.S. Provisional Application No. 61/666,241, filed Jun. 29, 2012.

FIELD OF THE INVENTION

The present invention relates to a charge ring and a fluid restriction purge arrangement for a paint spray tool.

BACKGROUND OF THE INVENTION

In the field of painted automotive components, robotic arms having paint spray tools are used for applying paint to a part. At the end of a robotic arm a paint spray tool is mounted. Several designs of paint spray tools incorporate the use of a charge ring, near the spray outlet of the paint tool for applying an electrical charge to the paint particles in midair as the paint leaves the spray outlet, and is blown toward the surface of the part. The system uses electrostatic attraction to charge the paint spray particles and cause them to be attracted to the part in order to prevent the particles from becoming airborne, over spraying or reflecting off of the surface of the part.

One particular problem with the use of a charge ring is that during a paint spraying operation, the probes of the charge ring can accidentally become covered with paint due to the close proximity of the paint spray tool and the part. When the probes of the charge ring become covered in paint, they lose their effectiveness to charge the paint particles coming off of the paint spray tool. It is therefore desirable to provide a paint spray tool arrangement that allows for adjustment of the charge ring for specific types of applications.

Another aspect of paint spray tools is that they have paint supply inlets where pressurized paint is connected to the paint spray tool and flows through conduits in the paint spray tool to a spray outlet. Different types of paints having different types of viscosities are used sometimes alone or simultaneously with paint having a different type of viscosity or consistency in order to achieve a desired finish. During operation of the paint spray tool, it is desirable to purge the main paint supply conduits of any paint within the tool body. In order to effectively purge the paint, it is desirable to have a proper orifice size in the purge conduit that is suitable for the viscosity of the paint that is being purged.

SUMMARY OF THE INVENTION

The present invention is directed to a charge ring and fluid restriction arrangement for a paint spray tool. The paint spray tool has a mounting bracket for connection to a mechanical arm and a tool connected to the mounting bracket having two or more paint supply inlets and one or more conduits extending through the body which lead to one or more spray outlets. A bell cup is connected to the body and circumscribes the spray outlets. The bell cup directs the spray coming off of the spray outlets in a specific direction.

In one embodiment of the present invention, a charge ring is slidably connected to and moveable along the longitudinal surface of the body. The charge ring has a lockable collar with one or more probes extending from the collar. The charge ring can move between a standard position and at least one secondary position.

In another aspect of the invention, at least one purge supply line is connected to the one or more conduits of the body between the two or more paint supply inlets and the one or more spray outlets. At least one interchangeable pre-orifice is positioned in the at least one purge supply line and the pre-orifice is interchangeable with other pre-orifices having different orifice diameters. A valve and main orifice is positionable in the at least one purge supply line upstream of the at least one interchangeable pre-orifice. During a paint purging operation, paint is purged from the conduit of the tool part of the body, through the pre-orifice and past the main orifice and valve. The use of the pre-orifice allows for effective purging of the paint from the conduit since the pre-orifice has an orifice diameter that is ideal for the viscosity of paint being purged from the conduit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
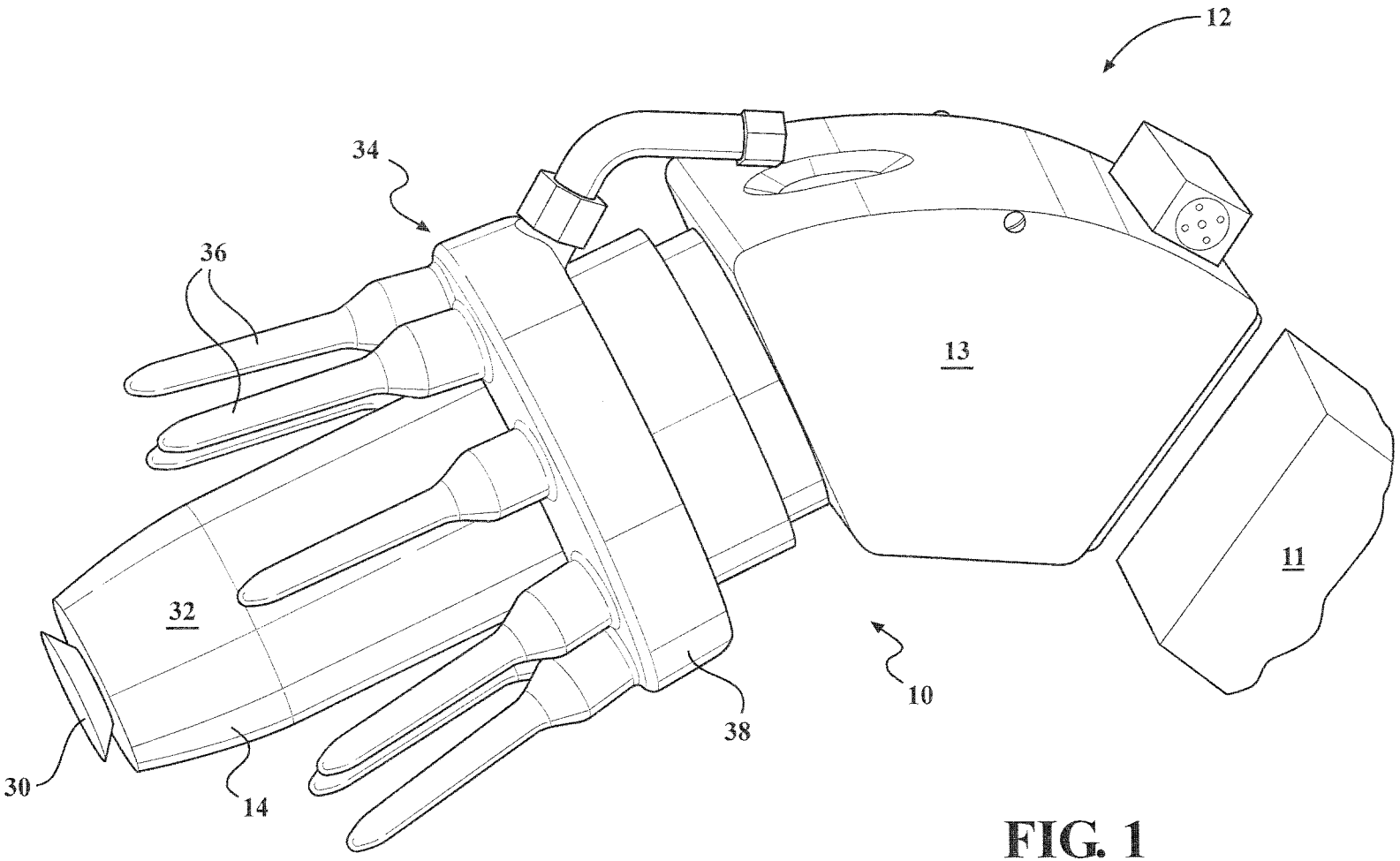
FIG. 1 is a perspective side view of a paint spray tool in accordance with the present invention.

Referring now to all the FIGS. 1-6 various views of a paint spray tool 10 are shown. The paint spray tool 10 has a mounting bracket 12 for connecting to a robotic arm 11. FIGS. 1 and 2A show a cover 13 on the mounting bracket 12, while FIG. 2B shows the cover 13 removed. A body 14 of the paint spray tool 10 is connected to the mounting bracket 12. The body 14 has two paint supply inlets 16, 16' (shown in FIG. 2B) and two conduits 18, 18' (shown in FIGS. 5 and 6). The conduits extend through the body 14 between the paint supply inlet 16, 16' and spray outlets 20, 20'. The paint spray tool 10 has two paint supply inlets 16, 16', conduits 18, 18', and spray outlets 20, 20', in order to accommodate two different types of paints or paint materials having different types of viscosity. For example, certain paint mixtures are aqueous or water based and therefore has a higher viscosity, while other solvent or organic based paint materials have a lower viscosity. Each type of paint material will travel separately through the paint spray tool 10 through independent paint supply inlets 16, 16' and spray outlets 20, 20'.

Connected to the conduits 18, 18' are two purge lines 22, 22', with one purge line connected to a respective conduit 18, 18'. The purge lines 22, 22' each have an interchangeable pre-orifice 24, 24' that is a cylindrical insert placed within the purge line 22, 22', the insert has an orifice diameter for allowing the flow of paint from the conduits 18, 18' through the purge line 22, 22'. The interchangeable pre-orifice 24, 24' can be interchanged with other interchangeable pre-orifices that have different orifice diameters. The use of the interchangeable pre-orifice 24, 24' in each purge line 22, 22' allows the purge line to be calibrated in order to effectively purge the conduits 18, 18' based on the type of paint or viscosity of the paint being used by the paint spray tool 10. Upstream of each interchangeable pre-orifice 24, 24' is a main orifice 26, 26' which has a valve 28, 28' that functions to open and close the main orifice 26, 26' in order to control the purging of paint from the conduits 18, 18', through the purge lines 22, 22'. Having an interchangeable pre-orifice 24, 24' allows you to control the flow of paint through the purge lines 22, 22' without having to completely remove and have multiple main orifices 26, 26' and valves 28, 28' in order to accommodate paints having various viscosities. The interchangeable pre-orifice 24, 24' can be interchanged with an alternate orifice 25, 25' having different dimensions and orifice diameters compared to interchangeable pre-orifice 24, 24'.

The paint spray tool 10 also has a bell cup 30 connected to the body 14 and circumscribing the spray outlets 20, 20'. The bell cup 30 helps to prevent back spray of paint and control the spray direction of the paint leaving the spray outlets 20, 20'.

In another aspect of the invention, the body 14 has a longitudinal surface 32 where a charge ring 34 is connected. The use of a charge ring in paint spray tools serves the purpose of electro-statically charging the paint particles as they exit the outlet of the paint spray tool, so that the paint particles will be attracted to the part being sprayed. The practice of using a charge ring to charge the paint particles helps to eliminate overspray and improve the consistency and evenness of paint applied to the part.

The charge ring 34 shown in accordance with the present invention has one or more probes 36 connected to a lockable collar 38. The probes 36 emit the electric charge that is applied to the paint particles leaving the spray outlets 20, 20'. During a paint spray operation, the paint spray tool 10 can move to close to the part or encounter overspray of paint which adheres to the probes, which causes the probes to become less effective in charging the paint particles.

Figure 2A:
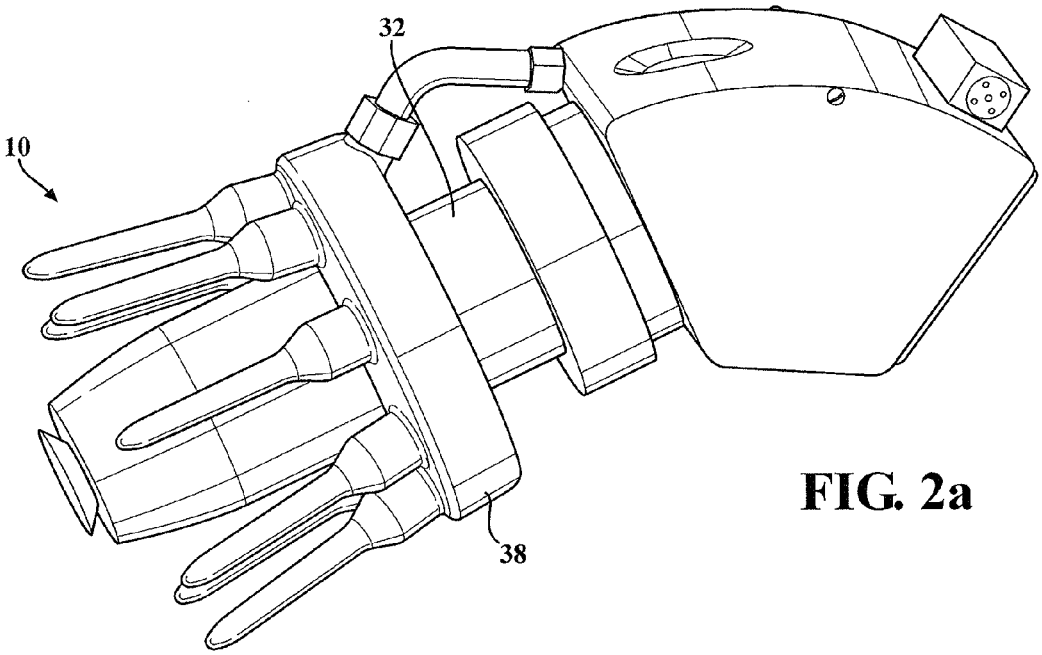
FIG. 2A is a perspective side view of a paint spray tool with the charge ring in a standard position.
Figure 2B:
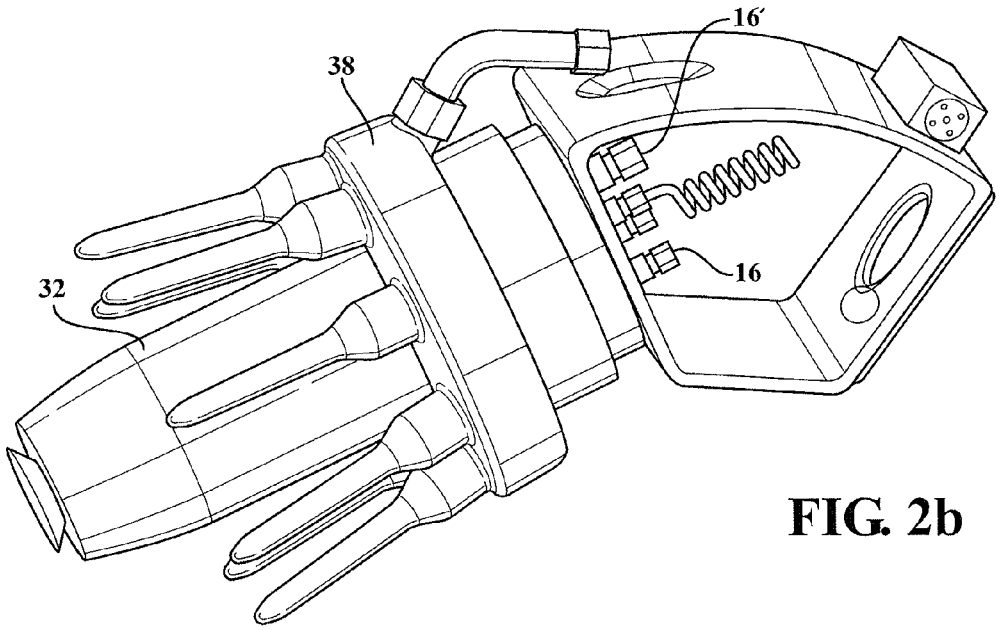
FIG. 2B is a perspective side view of a paint spray tool with the charge ring in a secondary position and having a mounting bracket cover removed.
Figure 3:
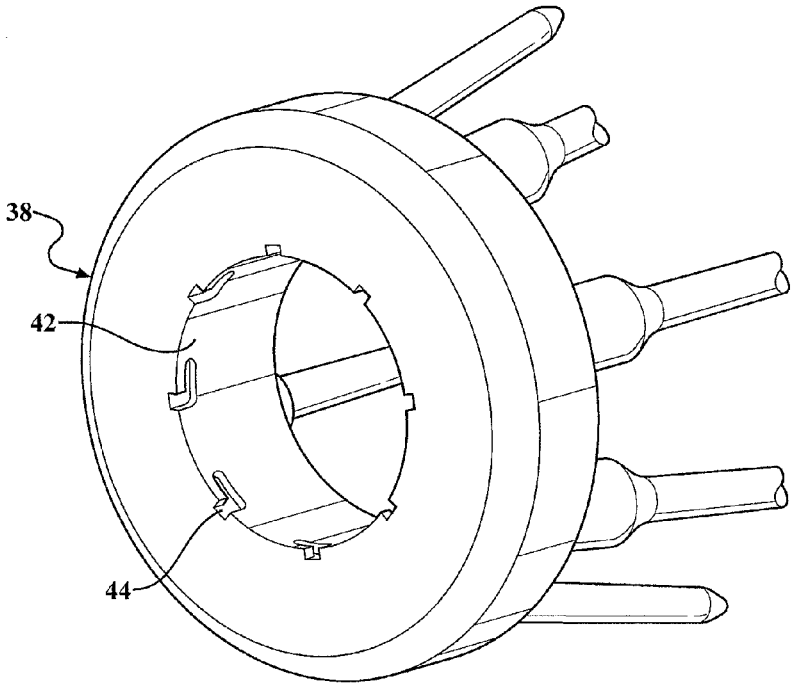
FIG. 3 is an enlarged rear perspective view of the charge ring with the tool body removed showing a groove on the inside sliding diameter of the charge ring.
Figure 4:
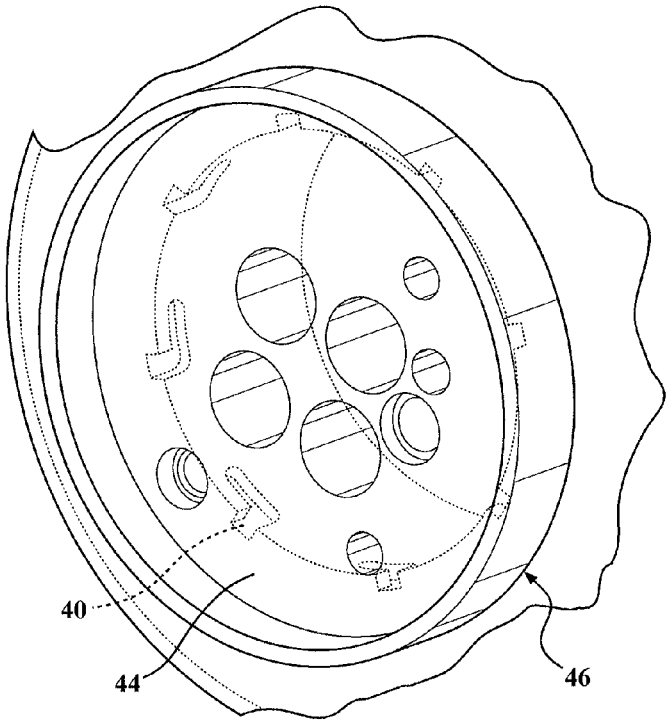
FIG. 4 is a cross-sectional enlarged perspective end view of the charge ring showing the groove on the surface of the charge ring and a tab on the tool body shown in phantom inside of the groove with the external charge ring in the locked position.
Figure 5:
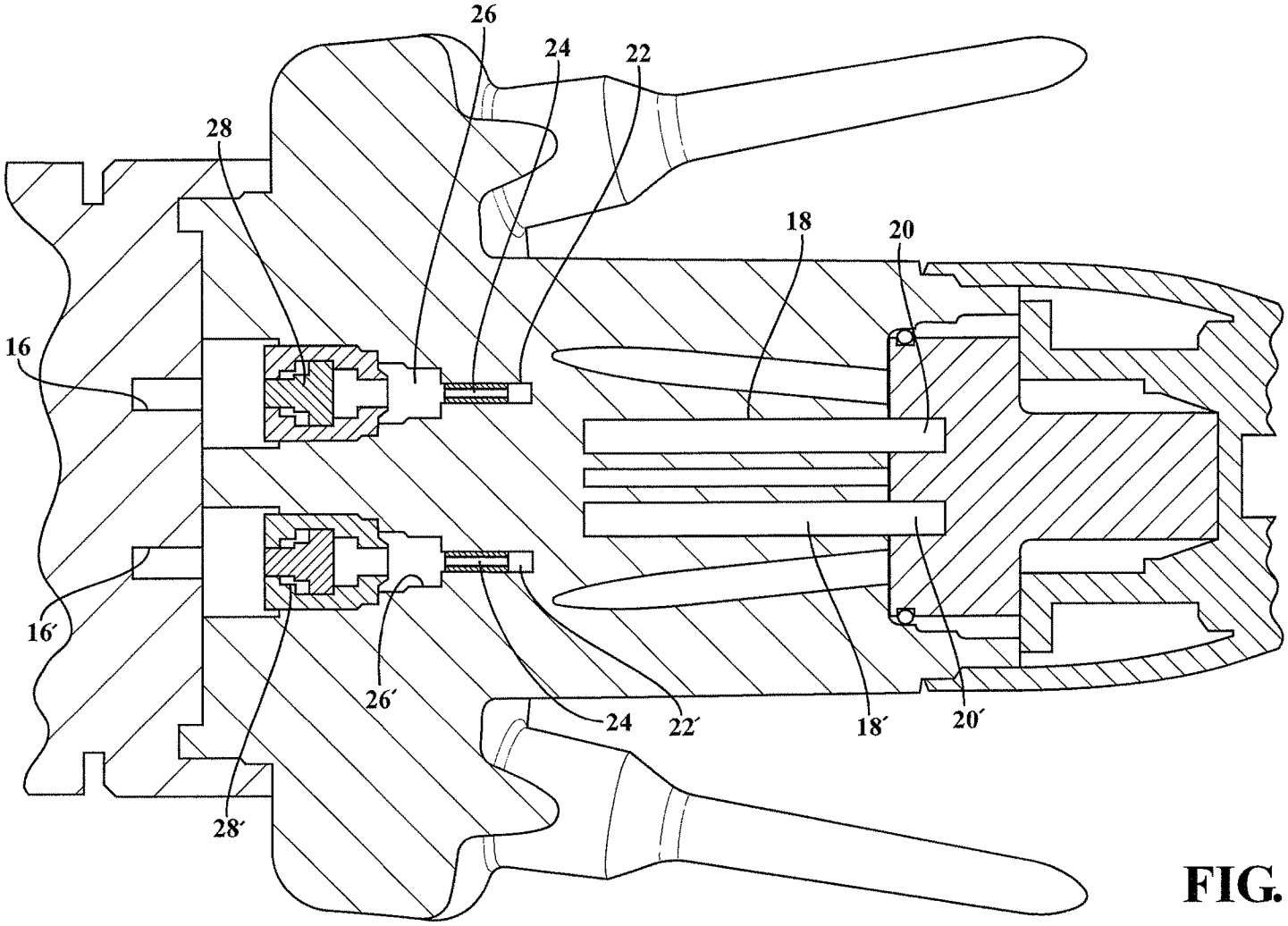
FIG. 5 is a cross-sectional plan side view of the charge ring and fluid restriction arrangement of the present invention.
Figure 6:
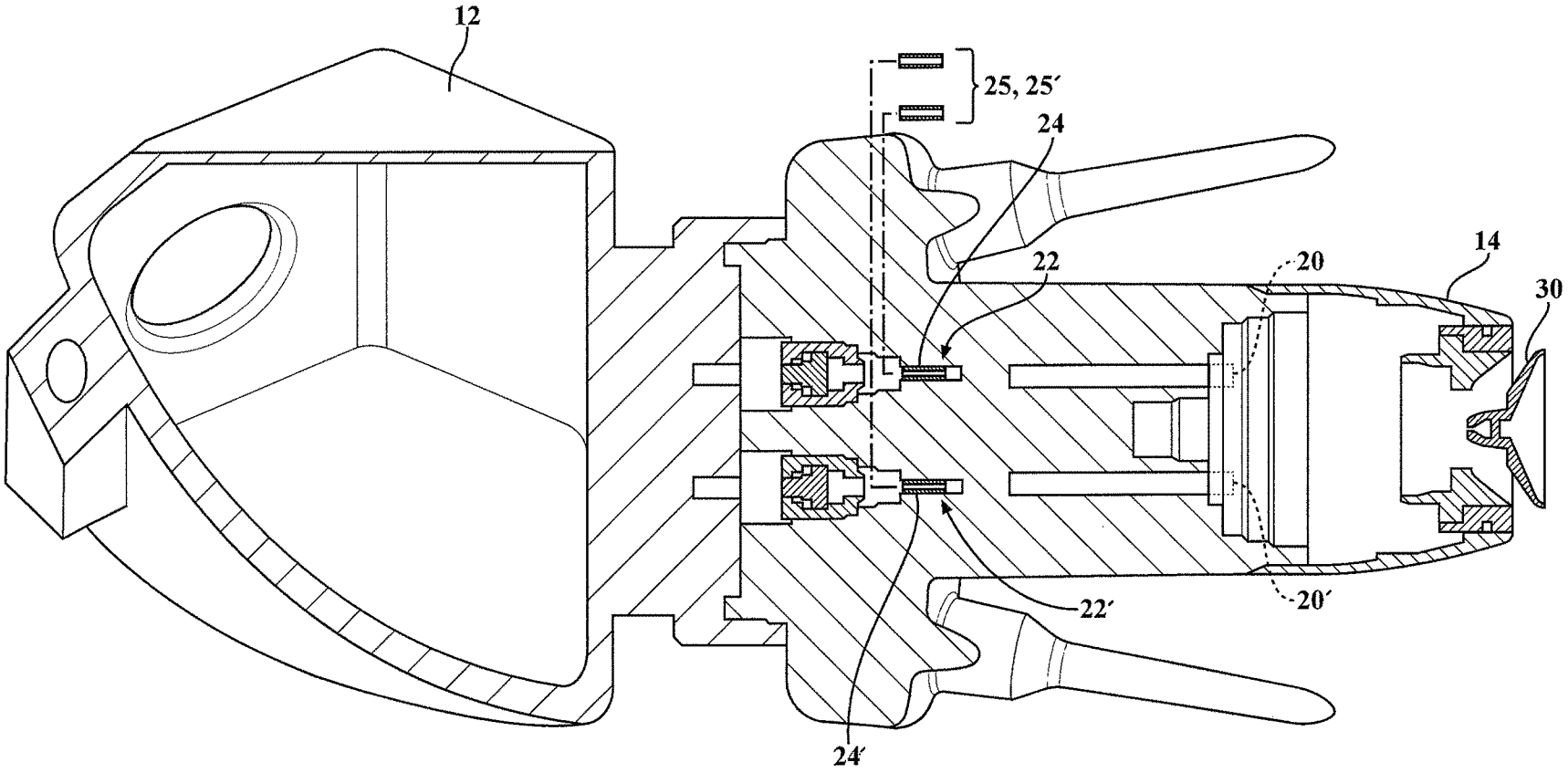
FIG. 6 is a second cross-sectional side view of the charge ring and fluid restriction arrangement for a paint spray tool in accordance with the present invention.

The present invention provides the lockable collar 38 which allows the charge ring 34 to be moved between a standard position (shown in FIG. 2A) and at least one secondary position (shown in FIG. 2B). The lockable charge ring 38 moves between positions using a protrusion 40 extending from an outside surface of the body, which locks into a locking groove 44 formed on an inside surface 42 of the lockable collar 38 (see FIG. 4). It is within the scope of this invention for the protrusion 40 and locking groove 44 to be placed on opposite surfaces. During movement of the charge ring 34 between the standard position and the secondary position, the lockable collar 38 is rotated in order to disengage the protrusion 40 from the locking groove and then allow the lockable collar 38 to slide along the longitudinal surface 32 of the body 14. It is within the scope of this invention for there to be several different secondary positions for the charge ring 34 depending upon the particular application. The use of the charge ring 34 in the present invention allows for the manual adjustment of the charge ring 34 if overspray onto the probes 36 is noticed or in spraying operations where it is known that the paint spray tool 10 will have to be in close proximity to the part being painted.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A paint spray tool comprising:

a mounting bracket for connection to a mechanical arm;

a body connected to the mounting bracket having two or more paint supply inlets and one or more conduits extending through said body leading to one or more spray outlets;

a charge ring slidably connected to the body and movable along a longitudinal surface of said body between a standard position and at least one secondary position;

one or more probes extending from said charge ring;

at least one purge line connected to said one or more conduits of said body between said two or more paint supply inlets and said one or more spray outlets; and at least one interchangeable pre-orifice positioned in said at least one purge line where said at least one interchangeable pre-orifice has an aperture having a diameter, said at least one interchangeable pre-orifice is interchangeable with at least one alternate orifice having different aperture diameter.

2. The paint spray tool of claim 1, further comprising a valve and main orifice positionable in said at least one purge supply line upstream of said at least one interchangeable pre-orifice.

3. The paint spray tool of claim 1, wherein said at least one interchangeable pre-orifice is a cylindrical insert having an aperture diameter, wherein said cylindrical insert when placed inside of said conduit extends between said at least one interchangeable pre-orifice and said main orifice.

4. The paint spray tool of claim 1 further comprising a bell cup connected to said body and circumscribing said one or more spray outlets.

5. The paint spray tool of claim 1 further comprising a lockable collar of said charge ring, said lockable collar has a protrusion on the longitudinal surface of said body and a locking groove on the surface of said collar adjacent said longitudinal surface of said body, wherein said protrusion slides into said groove and allows the said collar to be twisted in order to lock the position of said charge ring at said standard position or at said at least one secondary position.

6. A paint spray tool comprising:

a mounting bracket for connection to a mechanical arm;

a body connected to the mounting bracket having two or more paint supply inlets and one or more conduits extending through said body leading to one or more spray outlets;

a charge ring connected said body and having one or more probes extending from said charge ring;

at least one purge line connected to said one or more conduits of said body between said two or more paint supply inlets and said one or more spray outlets; and at least one interchangeable pre-orifice positioned in said at least one purge line and having an aperture diameter, wherein said at least one interchangeable pre-orifice is interchangeable with at least one alternate pre-orifice having a different aperture diameters.

7. The paint spray tool of claim 6 further comprising a valve and main orifice positionable in said at least one purge supply line upstream of said at least one interchangeable pre-orifice.

8. The paint spray tool of claim 6, wherein said at least one interchangeable pre-orifice is a cylindrical insert, wherein said cylindrical insert when placed inside of said conduit extends between said pre-orifice and said main orifice.

9. The paint spray tool of claim 6 further comprising a bell cup connected to said body and circumscribing said one or more spray outlets.

10. A paint spray tool comprising:

a mounting bracket for connection to a mechanical arm;

a body connected to the mounting bracket having two or more paint supply inlets and one or more conduits extending through said body leading to one or more spray outlets;

a charge ring slidably connected to and movable along a longitudinal surface of said body between a standard position and at least on secondary position;

one or more probes extending from said charge ring;

at least one purge line connected to said one or more conduits of said body between said two or more paint supply inlets and said one or more spray outlets;

at least one interchangeable pre-orifice having an aperture diameter positioned in said at least one purge line where said at least one interchangeable pre-orifice is interchangeable with at least one alternate pre-orifice having a different aperture diameter, wherein said cylindrical insert when placed inside of said conduit extends between said pre-orifice and said main orifice;

a valve and main orifice positionable in said at least one purge supply line upstream of said at least one interchangeable pre-orifice; and a lockable collar of said charge ring, said lockable collar has a protrusion on the longitudinal surface of said body and a locking groove on the surface of said collar adjacent said longitudinal surface of said body, wherein said protrusion slides into said groove and allows the said collar to be twisted in order to lock the position of said charge ring at said standard position or at said at least one secondary position.

11. The paint spray tool of claim 10 further comprising a bell cup connected to said body and circumscribing said one or more spray outlets.

12. The paint spray tool of claim 10 further comprising a valve and main orifice positionable in said at least one purge supply line upstream of said at least one interchangeable pre-orifice.

* * * * *